US010112097B2

(12) United States Patent
LoDuca et al.

(10) Patent No.: US 10,112,097 B2
(45) Date of Patent: Oct. 30, 2018

(54) ROBOTIC BATTING TEE SYSTEM

(71) Applicant: Robosport Technologies, LLC, Whitestone, NY (US)

(72) Inventors: Salvatore LoDuca, Great Neck, NY (US); Michael R. LaLuna, Merrick, NY (US); Nicholas J. Derba, Bangor, ME (US)

(73) Assignee: Robosport Technologies LLC, Whitestone, NY (US)

( * ) Notice: Subject to any disclaimer, the term of this patent is extended or adjusted under 35 U.S.C. 154(b) by 13 days.

(21) Appl. No.: 15/244,057

(22) Filed: Aug. 23, 2016

(65) Prior Publication Data

US 2018/0056160 A1 Mar. 1, 2018

(51) Int. Cl.
*A63B 69/00* (2006.01)
*A63B 102/18* (2015.01)

(52) U.S. Cl.
CPC ..... *A63B 69/0075* (2013.01); *A63B 69/0002* (2013.01); *A63B 2069/0008* (2013.01); *A63B 2102/18* (2015.10); *A63B 2102/182* (2015.10); *A63B 2207/02* (2013.01); *A63B 2210/58* (2013.01); *A63B 2220/805* (2013.01); *A63B 2220/833* (2013.01); *A63B 2225/093* (2013.01);
(Continued)

(58) Field of Classification Search
CPC ..... A63B 69/0075; A63B 69/0002; A63B 2102/18; A63B 2102/182; A63B 2069/0008; A63B 2207/02; A63B 2210/58; A63B 2220/805; A63B 2220/833; A63B 2225/093; A63B 2225/20
USPC .... 473/417, 451, 422, 454, 455, 432; 124/5, 124/78, 79
See application file for complete search history.

(56) References Cited

U.S. PATENT DOCUMENTS 2,040,228 A * 5/1936 Whiteley ..... A63B 63/00 273/371
3,006,647 A 10/1961 Lee
(Continued)

FOREIGN PATENT DOCUMENTS

JP 61-187393 6/1988
JP 03-37445 2/1991
(Continued)

OTHER PUBLICATIONS

English translation of Notice of Reasons for Refusal dated Jan. 28, 2014, in JP Patent Application No. 2012-216004.
(Continued)

*Primary Examiner* — Mitra Aryanpour
(74) *Attorney, Agent, or Firm* — Akerman LLP

(57) ABSTRACT

A batting tee system includes a housing, a ball holder for holding a ball, a neck coupled between the housing and the ball holder, an actuator, and a control system. The actuator may be positioned in the housing and operable to actuate the neck along the axis to extend and retract the neck from the housing thereby increasing and decreasing a distance between the ball holder and the housing. The control system may be operable to cause the actuator to actuate the neck to a first random position along the axis. The control system may be further operable to cause the actuator to actuate the neck to a second random position along the axis, different than the first, after a ball is hit from the ball holder when the neck is in the first position.

14 Claims, 8 Drawing Sheets

(52) U.S. Cl.
CPC ..... *A63B 2225/20* (2013.01); *A63B 2225/50* (2013.01)

(56) References Cited

U.S. PATENT DOCUMENTS 3,318,068 A 5/1967 Johannes
3,529,823 A 9/1970 Garver
3,588,104 A 6/1971 Griffin
3,940,132 A 2/1976 Lopatto, III
4,161,313 A 7/1979 Dickey
4,352,494 A 10/1982 Wells
4,456,250 A 6/1984 Perrone, Jr.
4,657,250 A * 4/1987 Newland ..... A63B 63/00 473/432
4,770,527 A 9/1988 Park
4,815,735 A 3/1989 McClenny
4,830,369 A * 5/1989 Poitras ..... A63B 63/00 473/455
4,834,375 A * 5/1989 Elstein ..... A63B 24/00 473/417
4,886,267 A * 12/1989 Licciardi ..... A63B 69/0075 473/417
4,995,607 A * 2/1991 Whitfield ..... A63B 24/0021 473/454
5,002,274 A * 3/1991 Bidema ..... A63B 63/00 473/417
5,046,729 A * 9/1991 Yancey ..... A63B 63/00 473/455
5,062,641 A * 11/1991 Poillon ..... A63B 24/0021 473/155
5,160,131 A 11/1992 Leon
5,228,683 A 7/1993 Beimel
5,388,823 A * 2/1995 Prieto ..... A63B 69/0075 473/417
5,401,016 A 3/1995 Heglund et al.
5,590,876 A 1/1997 Sejnowski
5,647,338 A 7/1997 Martin
5,848,945 A * 12/1998 Miller ..... A63B 69/0075 473/417
5,882,270 A 3/1999 Daugherty
6,042,492 A 3/2000 Baum
6,146,289 A 11/2000 Miller et al.
6,167,878 B1 1/2001 Nickerson et al.
6,296,582 B1 10/2001 Minniear
6,413,175 B1 7/2002 Mooney, Jr.
6,443,859 B1 9/2002 Markin
6,551,204 B1 4/2003 Di Re
6,551,205 B1 * 4/2003 Koelzer, Jr. ..... A63B 63/00 473/454
6,695,723 B2 * 2/2004 Leal ..... A63B 47/002 473/417
7,169,067 B2 * 1/2007 Town ..... A63B 69/0002 473/417
7,828,679 B2 11/2010 Tell et al.
D633,583 S 3/2011 Guervara
8,425,352 B1 4/2013 LoDuca et al.
8,597,141 B1 12/2013 Daniel
2001/0003106 A1 6/2001 Brenneisen
2003/0064836 A1 4/2003 Moss et al.
2005/0101418 A1 * 5/2005 Cech ..... A63B 69/0002 473/417
2005/0130770 A1 6/2005 Battisto
2005/0255945 A1 * 11/2005 Green ..... A63B 69/0002 473/417
2009/0082140 A1 3/2009 Liao
2012/0202621 A1 8/2012 Belt
2013/0196793 A1 * 8/2013 Murphy ..... A63B 69/0002 473/417
2013/0218308 A1 8/2013 Altschuler et al.
2016/0325151 A1 * 11/2016 Coyne ..... A63B 69/0002 473/417

FOREIGN PATENT DOCUMENTS

JP 08-066502 3/1996
JP 11-226164 8/1999
JP 2007-136137 6/2007
WO 9730767 8/1997

OTHER PUBLICATIONS

English translation of Notice of Reasons for Refusal dated Jun. 24, 2014, in JP Patent Application No. 2012-216004.

* cited by examiner

ROBOTIC BATTING TEE SYSTEM

TECHNICAL FIELD

The present disclosure is related to baseball/softball batting/hitting tees, more specifically the present disclosure is related to robotic or automated tees.

BACKGROUND

Hitting a baseball or softball is one of the most difficult skills of all sports to master. Attempts at mastery require batting practice, often taking the form of tee work. Indeed, tee work in baseball is heavily promoted, encouraged, and even mandated as a training tool at all levels of competition, from Little League to the Majors. The main purpose of tee work is to aid batters in maintaining consistent form in their swing path so that contact with the ball will produce line drive hits. Batting tees generally have a ball holder that extends from a home plate shaped support. The ball holder may be mounted along an adjustable neck allowing the player or coach to grasp the neck to adjust the height of the ball holder relative to the base shaped support and hence the ball when positioned on the holder. In use, a hitter takes stance adjacent to the tee and hits the ball off the ball holder.

SUMMARY

According to various embodiments, the present disclosure describes a batting tee system that seeks to shift the paradigm of tee work that historically defines "muscle memory" from a historical mode of "repetition" to a new methodology that embraces "randomization". By embedding randomization software, for example, within a robotic (mechanical) batting tee apparatus, batters can be prevented from sequentially hitting balls off of the tee in the same consecutive spot. This randomization approach prevents "locking in" a batters swing path or swing "groove" to a particular point or area within a batters strike zone. Hence, the methodology of randomization produces a contextual interference effect that drives enhanced flexibility and fluidity to make better contact anywhere in the strike zone and not just in areas where a batter feels they are most proficient, e.g., the batter's "hot zone". It is believed that contextual interference and randomization modes as applied to sport specific training provides longer term learning patterns as well.

In one aspect, the batting tee system includes a housing, a ball holder for holding a ball, a neck coupled between the housing and the ball holder, an actuator, and a control system. The actuator may be positioned in the housing and be operable to actuate the neck along the axis to extend and retract the neck from the housing, thereby respectively increasing and decreasing a distance between the ball holder and the housing. The control system may be operable, e.g., via electrical signals, hardware, programmed or programmable circuits, etc., to cause the actuator to actuate the neck to a first random position along the axis. The control system may be further operable to cause the actuator to actuate the neck to a next or second random position along the axis, different than the first, after a ball is hit from the ball holder when the neck is in the first position.

In various embodiments, the control system comprises a ball presence sensor positioned to collect ball presence data that the control system analyzes to determine if the ball has been hit from the ball holder. The ball presence sensor may comprise an Infrared ("IR") proximity line-of-sight sensor used to detect the presence of a ball on the ball holder. The neck may be completely retractable into the housing. A length of the neck may increase when the distance between the ball holder and the housing increase. The length of the neck may decrease when the distance between the ball holder and the housing decreases. In one example, the neck comprises nestable telescoping sections that move along the axis when the neck is actuated along the axis. In one embodiment, the control system comprises a remote user interface to interface a user with operations of the control system. The remote user interface may be operable to define a minimum and maximum range within which the first and second random positions along the axis are to be generated.

In some embodiments, the batting tee system includes a location indicator system. The location indicator system may include an illumination device having an illumination source. The illumination device is operable to illuminate a goal location away from a ball holder of a batting tee with light emitted from the illumination source. The location indicator system may also include an actuator. The actuator may transition the illumination between sequential goal locations by directing the light emitted from the illumination source. The location indicator system may also include a control system operable to cause the actuator to direct the light emitted from the illumination source to a first random goal location. The control system is further operable to cause the actuator to direct the light emitted from the illumination source to a second random goal location, different from the first random goal location, after a ball is hit from the ball holder when the first random goal location is illuminated. In one example, the actuator directs the light emitted by the illumination source by one of moving the illumination source, redirecting the light that is emitted by the illumination source, or both.

In various embodiments, the control system of the location indicator system comprises a remote user interface to interface a user with operations of the control system. In one example, the remote user interface may be operable to define a range within which the first and subsequent random goal locations away from the ball holder are to be generated. In this or another example, the control system configured to cause actuation of the neck may also comprise or operably integrate the remote user interface to interface a user with the operations of the control system. For example, the remote user interface may be operable to define a minimum and maximum range within which the first and second random positions along the axis are to be generated. Either control system or a combined or integrated control system may include a ball presence sensor to collect ball presence data to determine if the ball has been hit from the ball holder. In one example, the control system of the location indicator system or a combined or integrated control system is in signal communication, e.g., wired, wireless, or both, with the ball presence sensor to receive ball presence data from the sensor to determine if the ball has been hit from the ball holder. In one embodiment, the control system of the location indicator system is configured for signal communication, e.g., wired, wireless, or both, with the control system configured to cause actuation of the neck to receive a signal that the ball has been hit from the ball holder. In one embodiment, the actuator of the location indicator system is in signal communication, via a wired or wireless communication port, with the control system configured to cause actuation of the neck. The control system configured to cause actuation of the neck may be operable to cause the actuator of the location indicator system to direct the light emitted from the illumination source.

In another aspect, a location indicator system for a batting tee includes an illumination device having an illumination source. The illumination device is operable to illuminate a goal location away from a ball holder of the batting tee with light emitted from the illumination source. The location indicator system may also include an actuator. The actuator may transition the illumination between sequential goal locations by directing the light emitted from the illumination source. The location indicator system may also include a control system operable to cause the actuator to direct the light emitted from the illumination source to a first random goal location. The control system is further operable to cause the actuator to direct the light emitted from the illumination source to a second random goal location, different from the first random goal location, after a ball is hit from the ball holder when the first random goal location is illuminated. In one example, the actuator directs the light emitted by the illumination source by one of moving the illumination source, redirecting the light that is emitted by the illumination source, or both.

The control system of the location indicator system may include various sensors. For example, the control system may include a ball presence sensor to collect ball presence data that the control system analyzes to determine if the ball has been hit from the ball holder. In some embodiments, the control system of the location indicator system comprises a remote user interface to interface a user with operations of the control system. The remote user interface may be operable to define a range within which the first and second random goal locations away from the ball holder are to be generated. In one embodiment, the control system is configured to integrate with a control system of the batting tee to provide a remote interface operable to (a) define a range within which the first and second random goal locations away from the ball holder are to be generated and (b) define a range within which a neck of the batting tee is to be actuated to position a ball holder at different positions along an axis, which may be random positions. When the neck is actuated to a first position within the range, the actuator of the location indicator system may one of direct the light emitted from the illumination source to the first random goal location within defined the range. When the neck is actuated to a second position within the range, the actuator of the location indicator system may direct the light emitted from the illumination source to second random goal location within the defined range. In one example, the control system combines or integrates with the control system or actuator of the batting tee through an accessory fitting on the batting tee to which the location indicator system electrically connects. The accessory fitting may comprise a data link port operable as a communication port.

In one embodiment, the illumination device includes a communication port configured to pair with a communication port of the batting tee. The batting tee may include an actuator for actuating a neck along an axis to raise and lower the ball holder attached to an end of the neck. The control system may comprise an integrated control system when the communication ports are paired. The integrated control system may comprise a remote user interface to interface a user with the actuation of neck as well as directing of the light emitted from the illumination source.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Figure 1:
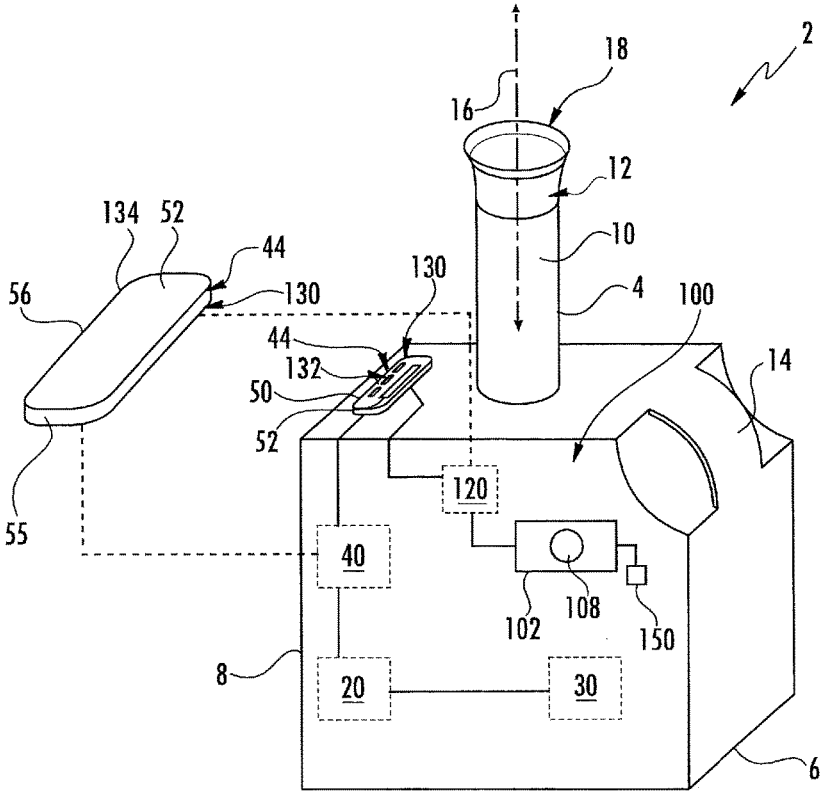
FIG. 1 is a semi-schematic of a tee system including a location indicator system according to various embodiments described herein.

Batters participating in tee work will typically position a ball holder of a batting tee based on individual preferences for comfort or hot zones. Balls are repeatedly placed on the ball holder, hit, and replaced. This repetitious hitting of balls positioned at the same spot creates muscle memory or a proprioceptive-neurological pathway that locks in a motor muscular swing path or groove to a particular spot within the strike zone. In baseball, batters have milliseconds to perceive an incoming pitch and square up by positioning their arms and hands to meet the center of the ball with the barrel of the bat. When batters require motor muscular flexibility in the game to meet an incoming pitch, their swing path will automatically and involuntarily be driven to a positional spot where a baseball has been hit hundreds or thousands of times during tee work. Hence, the swing path becomes preprogrammed, seemingly more robotic than robots themselves.

Although batters may move the tee to the inner, outer, front, or back portions of the strike zone, typically the ball will be repetitively replaced on the ball holder positioned at the same height even where the height of the ball holder may be adjusted by grasping the neck and physically extending or shortening the neck. In these instances, while the ball is correspondingly moved to various portions of the strike zone, the batter is repeatedly hitting the ball in the same spatial plane, which provides little resolution to train to the fullest flexibility within the strike zone.

Without being bound to theory, it is believed that the brain works in a paradoxical manner with respect to hitting. That is, while the brain prefers repetition (utilizing brain pathways most often used or of least resistance) it can only learn when it is stretched (fostering neural plasticity) or presented with unfamiliar or novel experiences ("opening" and "activating" dormant or unused neural pathways). In this respect, traditional tee usage may actually inhibit rather than foster hand-eye coordination.

A tee system is described herein which may be used to teach consistent good contact, with consistent good form, anywhere in the strike zone, not just where a batter feels most proficient. The tee system may be configured to position a ball holder at various heights along an axis. Movement of the ball holder between the height positions along the axis may be automated (robotic). The selection of the height positions may also be automated. For example, a control system may be programmed with height position data used to execute selection of height positions. The height position data may include one or more sequences of height positions. The height position data may include one or more generated sequences of random height positions. The number of height positions in a sequence or number of sequences may be large enough such that a batter is unlikely to perceive or unconsciously key in on height positions as to anticipate repetition over multiple exposures to the sequence. Sequences may be associated with ranges of heights, which may be selected by a user. In some instances, the control system may be configured to skip height positions within a sequence that are outside a range set by a user. The control system may also be programmed to generate height position data comprising random height positions within a range of height positions.

The tee system and components for use with tee systems are described further below with reference to FIGS. 1-7, wherein like numerals are used to identify like features.

With reference to FIG. 1, in various embodiments, the tee system 2 includes a body 4 comprising a base 6, a housing 8 positioned on the base 6, a neck 10 extendable and retractable from the housing 8, and a ball holder 12 positioned on the neck 10.

The tee system 2 is preferably configured to be man-portable yet stable enough to prevent falling over due to a mishit from a batter. For example, the base 6 may provide a stable platform for mounting of the neck 10, ball holder 12, and other components without adding unnecessary weight to the system 2. In the illustrated embodiment, the housing 8 includes a handle 14 dimensioned to be gripped by a user for transporting the tee system 2. The base 6 may be wider than the housing 8, longer than the housing 8, or both to provide stability. The base 6 may include a rubber-like lower surface to increase friction with the ground surface upon which the body 4 may be placed.

The neck 10 may be formed of a rigid material that is durable to withstand mishits. For example, the neck 10 may be constructed of metals or hard plastics, e.g., a combination of metal and HDPE plastic tubes. In one embodiment, the neck 10 includes a topple feature wherein a strong mishit causes the top of the neck 10 to pivot downward to prevent breaking the neck 10 or toppling the tee system 2.

The neck 10 extends between the housing 8 at a first end and mounts the ball holder 12 at a second end. The neck is movable along an axis, indicated by double arrow axis 16. Extension or retraction of the neck 10 with respect to the housing 8 may be robotically driven. For example, the tee system 2 may include a robotically extendable and retractable neck 10 with respect to the housing 8 operable to adjust the height of the ball holder 12 and, hence, a ball when positioned on the ball holder 12. In various embodiments, the body 4 includes a housing 8 that can completely encase the neck 10 after use. For example, the neck 10 may include a telescopic piston that may be folded or enveloped into the housing 8 for storage.

The ball holder 12 may include a ball seat 18 to hold a ball, such as a baseball or softball. The ball holder 12 may be constructed of a durable plastic or rubber-like plastic or polymer. In various embodiments, the ball holder 12 may include three or more prongs forming the ball seat 18. In one example, the prongs are adjustable to modify the size of the ball seat 18 to provide holding capabilities for larger and smaller balls. In some embodiments, the ball holder 12 is modular such that it may be removed and replaced to replace worn components or customize the ball holder 12 or ball seat 18. The ball holder 12 may therefore be interchangeable with other ball holders 12. As described in more detail below, in some embodiments, the ball holder 12 may include sensors or integrate accessory components such as location indicators. As such, a user may interchange ball holders 12 to mount a ball holder 12 that adds, upgrades, or remove features. In some embodiments, certain ball holders 12 may not be interchangeable in-whole or in-part.

The tee system 2 may be coupled to a power source to provide power to the tee system 2. For example, the tee system 2 may be powered by a power source comprising one or more batteries, an a/c outlet, or combination thereof In the illustrated embodiment, the tee system 2 includes an onboard (associated with or mounted on the body 4) rechargeable battery 20 of the SLA or LiPo type. As described in more detail below, in some embodiments, the body 4 may include a power fitting to couple an accessory component to the tee system 2 such that the tee system 2 may provide power to the accessory component using the tee system 2 power source or another power source associated with the tee system 2.

Figure 2:
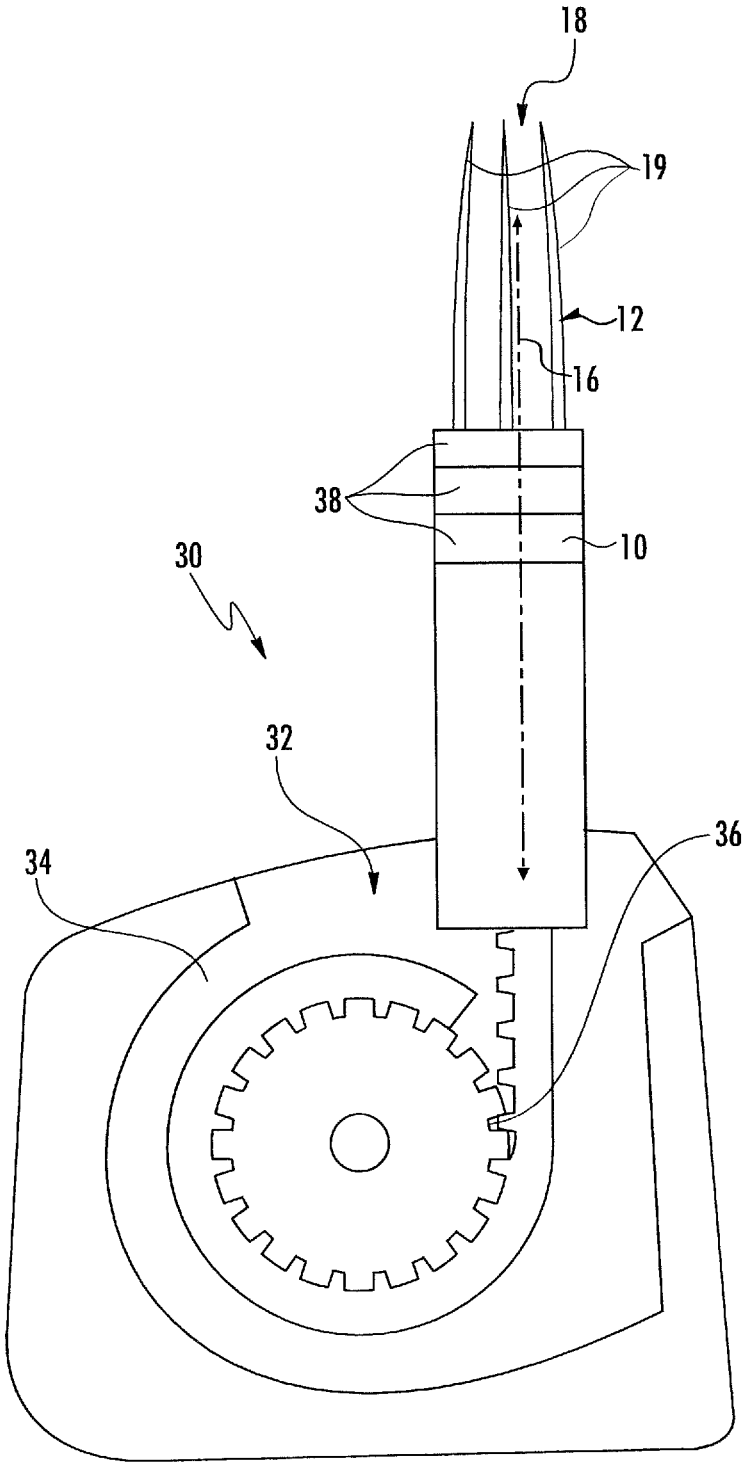
FIG. 2 illustrates an actuator, neck, and ball holder according to various embodiments described herein.

The tee system may also include an actuation system 30. With further reference to FIG. 2 illustrating an actuation system 30 and a ball holder 12 according to one embodiment, the actuation system 30 may comprise a neck 10 movable along the axis 16 by an actuator 32 comprising one or more motors 34 and linkages 36. A length of the neck 10 may increase to increase distance between the ball holder 12 and the housing 8 and the length of the neck 10 may decrease to decrease distance between the ball holder 12 and the housing 8. For example, the neck 10 may have telescoping sections 38 that move along the axis 16 to actuate the neck 10. In the embodiment illustrated in FIG. 2 and FIGS. 3A & 3B, described below, the telescoping sections 38 are nestable. In another embodiment, the length of the neck 10 may remain the same when the neck 10 is actuated along the axis 16 to increase or decrease the distance between the ball holder 12 and the housing 8. For example, the distance between the ball holder 12 and the housing 8 may be proportional to the length of the neck 10 retracted into and extended from the housing 8.

A ball holder 12 is mounted to the neck 10. The ball holder includes three prongs 19 made from a durable and flexible polycarbonate material. The extended length of the prongs 19 may function to protect the lower portions of the telescoping neck 10 in the event of swing mishaps. The prongs 19 may be thin and flexible, making the ball look like it is floating on air and produce little drag with bat-ball contact. The three prong 19 ball holder 12 can be used for various ball diameters including those of Major League Baseball approved baseballs and regulation softballs. The three prong 19 ball holder may be provided in a cartridge form that may be fitted on top of the neck 12 and secured.

The motor 34 and linkages 36 may be housed in the housing 8. The actuation system 30 may be operable to actuate the neck 10 along the axis 16 within a range extending approximately 20 inches, approximately 25 inches, approximately 30 inches, approximately 35 inches, or more. For example, the actuation system 30 may be operable to actuate the neck 10 within a height range taken between the lower side of the base 6 and the top side of the ball holder 12 of approximately 17 inches to approximately 48 inches.

In various embodiments, the motor 34 may comprise an electric, hydraulic, or pneumatic motor. The motor 34 may be configured to transmit rotational or linear force to the neck 10. In some embodiments, the actuation system 30 also includes a pump to pump hydraulic fluid or gas. For example, in one example, linkages 36 include a pneumatic or hydraulic chamber and a piston movable through the chamber when fluid is pumped into or out of the chamber. The neck 10 may extend from or otherwise be coupled to the movement from the piston to thereby actuate the neck 10 along the axis 16. In some embodiments, the neck 10 may be structured to telescopically extend and retract when engaged by the actuator 32. In the embodiment illustrated in FIG. 2, the neck 10 is structured to telescopically extend and retract when engaged by the actuator 32 wherein the motor 34 and linkages 36 are configured with the neck 10 in a manner similar to a powered telescoping antenna. In a further example, the actuation system 30 may produce a typical actuation rate of approximately 4 inches per second, although other actuation rates may be used. In some embodiments, linkages 36 may also include gearing along the neck 10 that interfaces with gears drivable by the motor to change the distance the neck 10 extends from the housing 8. In one such example, the motor 30 includes an reversible electric motor. In some embodiments, linkages 36 include gearing operable to engage or disengage actuation of the neck 10 or the direction along the axis 16 the neck 10 moves.

Figure 3A:
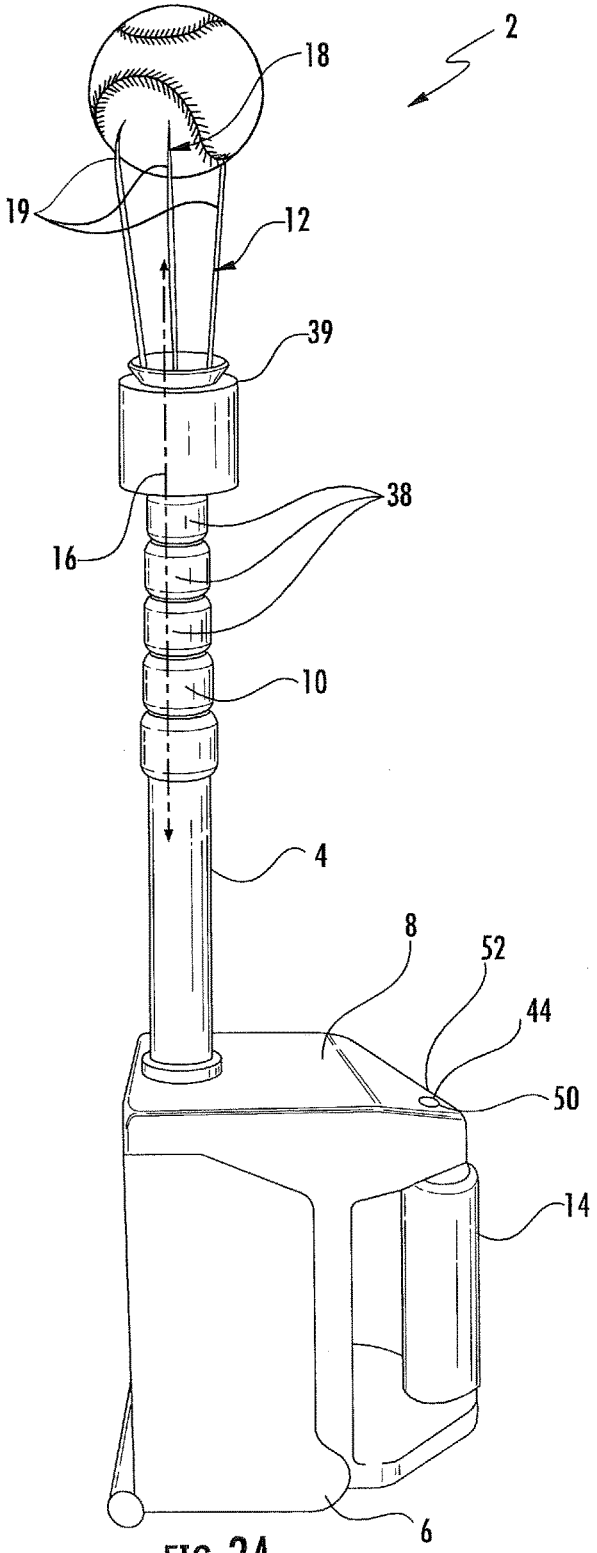
FIG. 3A illustrates a tee system according to various embodiments described herein.
Figure 3B:
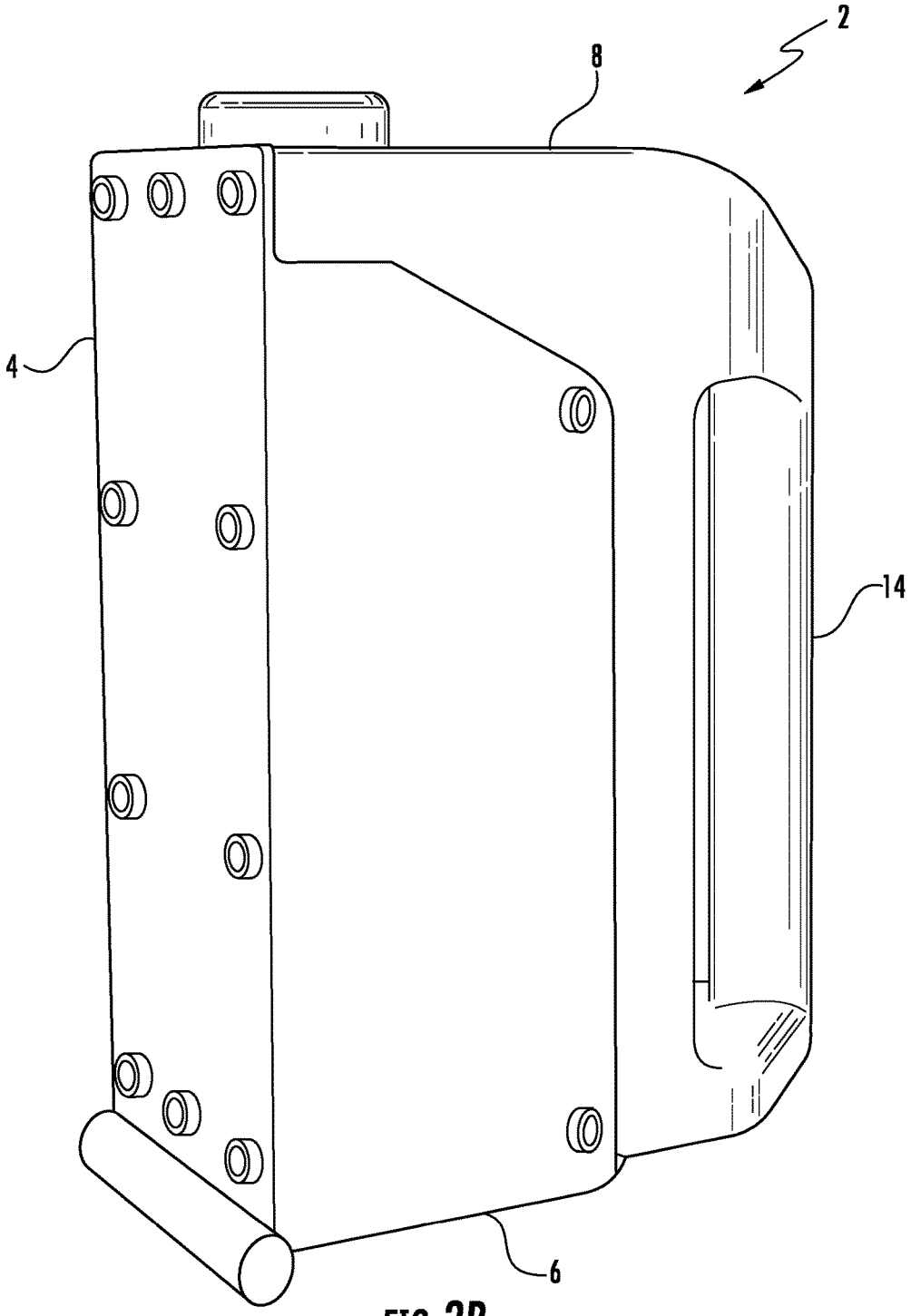
FIG. 3B illustrates the tee system of FIG. 3A with the neck encased in the housing according to various embodiments described herein.

FIGS. 3A & 3B illustrate another embodiment of the tee system 2. The neck 10 includes a telescoping neck 10 having nestable sections 38, which may be similar to the neck 10 described above with respect to FIG. 2. The ball holder 12 includes a three prong 19 ball holder, which may be similar to the ball holder 12 described above with respect to FIG. 2. An upper end of the neck 10 is fitted with a shock absorber 39 comprising a foam collar to reduce potential damage to the neck 10 and associated components on mishits. The neck 10 may be extendable from the housing 8 and retractable into the housing 8. As illustrated in FIG. 3B, the neck 10 may be fully retractable into the housing 8, e.g., for storage.

Figure 4:
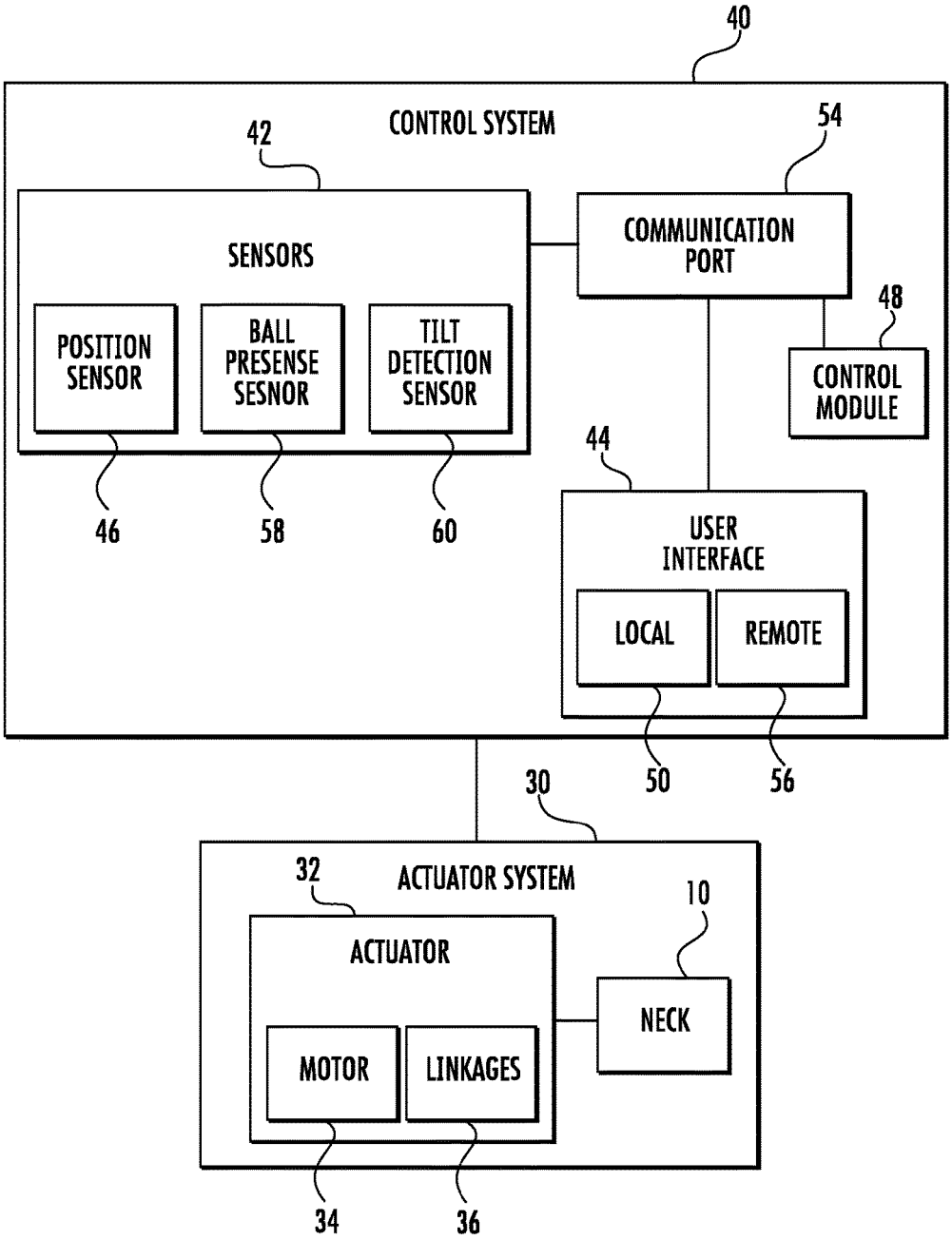
FIG. 4 schematically illustrates various operational features of a tee system according to various embodiments described herein.

Referring again to FIG. 1, in various embodiments, the tee system 2 includes a control system 40 operable to control the operations of the tee system 2. With further reference to FIG. 4, schematically illustrating features of a control system 40 according to various embodiments, the control system 40 may provide for actuation (motor control) of the movement of the neck 10 along the axis 16, sensing using sensors 42, and a user interface 44 for interfacing the user with the operations of the control system 40. For example, the control system 40 may include sensors 42 comprising position sensors 46 or be configured to receive, via wired or wireless communication, position data from one or more position sensors 46 positioned to collect position data that may be used by the control system 40 to determine a position corresponding to the position of the neck 10 or ball holder 12. In some embodiments, the control system 40 and actuation system 30 comprise a servomechanism. In one embodiment, the position sensor 46 includes a potentiometer to monitor the rotation of a disc drive of the motor which corresponds to the neck 10 height position. The potentiometer may be a multi-turn potentiometer, for example, providing for simple determination of the height of the neck 10 or ball holder 12 at any point in time after being powered ON. In this or another embodiment, the control system 40 incorporates a stepper motor or servomotor configured with position control incorporating an encoder or potentiometer in a closed loop. The control system 40 may also include a PID controller, for example, to receive and interpret the position data and provide corresponding control signals to control operation of the actuator 30.

In various embodiments, the control system 40 includes a control module 48. The control module 48 may include a processor configured to execute instructions, which may be hardwired into the processor. The control module 48 may also include memory for storing instructions executable by the processor. For example, the control module 48 may comprise a microcontroller chip with general purpose I/O. Operational embedded software may be programmed to detect the presence of balls using sensor data, generate random heights to position the neck 10 through the closed-loop control system 40, and allow user interaction via the user interface 44. The control module 48 may also include a microcontroller board to interface with the actuator system 30, sensors 42 and input devices, and perform high level control of the tee system 2. The control system 40 may also include a height selection switch. For example, the neck 10 may be actuated along the axis 16 within a height range. A 3-way/5-way position switch, for example, may be used as an input device to select an appropriate height zone. This switch may be connected to the microcontroller board and the software may be programmed to generate random positions within the height zone selected by a user at the user interface 44 or using a predetermined zone range. Other switch mechanisms may be used. In one embodiment, the height range may be between 17" to 48" taken between the ball holder 12 and base 6.

The user interface 44 may include a local user interface 50 providing operations such as height range selector switch, default movement, etc. In one example, a user, at the local user interface 50, may specify a height zone within the range within which the control system 40 is to actuate the neck 10, e.g., random heights within the range. The local user interface 50 may include a display 52. The display 52 may include LED indicators to inform the user about the operational state of the tee system 2, for example a red LED may indicate actuation, e.g., when the neck 10 is about to move, is moving, or both, and a green LED may indicate the neck 10 is properly positioned or the neck 10 is properly positioned along with the ball in the ball seat 18.

The control system 40 may also include a communication port 54, which may include multiple communication ports 54. The communication port 54 may include a receiver, transmitter, transceiver, etc. The communication port 54 may be configured to allow communication between the control system 40 and other devices, such as sensors 42, external or remote devices 55 or interfaces 44, e.g., an accessory device, wired or wirelessly coupled to the communication port 54. For example, the communication port 54 may comprise a transceiver configured for wired communication, wireless communication, or both. In one embodiment, the communication port 54 is configured for wired communication such as Bluetooth, IR, Wi-Fi, radio, etc. The communication port 54 may transmit operational data, e.g., to a remote device such as a computer, laptop computer, tablet, smart phone/device, or dedicated remote device to provide a remote interface 56.

The communication port 54 may be configured for communicating with external or remote devices 55 using Bluetooth. For example, the communication port 54 may include Bluetooth communication hardware to wirelessly pair the control system 40 with an external or remote device 55 such as a smart phone, hearing device, tactile-vibration feedback device, or combination thereof. Thus, the user, using a mobile application running on a mobile device may use the remote interface 56 to remotely set the minimum and maximum height, or range, within which the actuation system 30 will randomly actuate the neck 10. Similarly, a user may use the local interface 50 on the body 4 to set the minimum and maximum height, or range, that the actuation system 30 will actuate the neck 10. In one embodiment, the remote user interface 56 or local user interface 50 is configured to allow a user to program a particular sequence of heights.

A randomization software package may be embedded in the control system 40 so that the actuation system 30 does not actuate the neck 10 to the same position consecutively. The software package may include a random height generator operable to generate random heights within a defined range. As noted above, in one embodiment, the control system may be programmed with random height sequences that may be executed during operation of the tee system 2. In one embodiment, the control system 40 will not allow a user to keep the neck 10 at the same height for more than one hit with the idea that a batter should not hit a ball in the same consecutive spot.

In one embodiment, the user interface 44 may be programmed to suggest a batter not keep the body 4 in any one position for more than a certain number or range of balls, e.g., 5 to 10 hit balls. The batter may input how many balls he may want to hit with the body 4 in any one position. Once that number of hits is reached, the control system 40 may emit a signal to the batter to move the body 4 to another position around the plate to get maximum resolution within the cubical area of a batters particular strike zone.

In various embodiments, the control system 40 includes sensors 42 positioned to detect ball data. Example sensors 42 may include sensors 42 to detect ball position, ball hit, or vibration for estimating the speed of the ball. In a further example, such detection may be achieved through an embedded processor integrated with an accelerometer and an IR proximity sensor. One or more of the sensors 42 may be located along the neck 10 or ball holder 12, for example. The sensors 42 may be wired to the control module 48 or may be configured for wireless communication with the control module 48. For example, in one embodiment, a microprocessor module is integrated with one or more of the sensors 48 and a Bluetooth interface and is configured for communication with the control module 48. When received by the control module 48, which may be located in the body 4, the ball data may be used by the control module 48 to signal placement of a new ball on the ball seat 18 or to initiate actuation of the neck 10 to the next position. The control module 48 may also display data obtained from the ball data on display 52 of the local user interface 50 or transmit the data to an external or remote device 55, such as a paired mobile device or computer running an application of the tee system 2 as a remote user interface 56.

In various embodiments, the sensors 42 include a ball presence sensor 58 to detect presence of the ball. The sensor 58 may be used to determine when a ball has been hit to know when to actuate the neck 10 to the next random location. The ball presence sensor 58 may incorporate any suitable sensor technology. For example, the ball presence sensor 58 may detect vibration or movement of the ball holder 12, movement of a ball from the ball holder 12, weight of or weight change with respect to the ball holder 12, light or optical sensors, sound sensors, or other suitable sensors. In one embodiment, the ball presence sensor may include an IR proximity line-of-sight sensor used to detect the presence of a ball on the ball holder 12. The ball presence sensor 58 can also be used to detect idle/no activity time, in which the tee system 2 may switch off or go into a low power sleep mode to conserve power.

In one embodiment, the sensors 42 include a tilt detection sensor 60. The tilt detection sensor 60 may include an accelerometer, for example, to detect tilt data. The tilt detection sensor 60 may be mounted in the body 4. When the control module 48 receives tilt data from the tilt detection sensor 60 that indicates that the tee has fallen over, the control system 40 may be configured to stop the motor 34 from actuating the neck 10 to avoid damage to the actuation system 30. The control system 40 may also be configured such that the tee system 2 is operational only when the body 4 is upright.

In one embodiment, the tee system 2 is a compact, standalone, one axis, robotic tee having a telescoping neck 10. The telescoping neck 10 is configured to extend to a minimum height of 18 inches and a maximum height of 48 inches off the ground. The tee system 2 is low weight for easy positioning and transport. The control system 40 controls the actuation system 30 such that the telescoping neck 10 may be actuated to particular random height that is set between the minimum and maximum height that is preprogrammed into the control system 40 at the user interface 44. The user places a ball on the tee and hits. An appropriate ball presence sensor 58 collects ball presence data which is used by the control module 48 to determine that the ball was hit. The control module 48 then initiates the actuation system 30 to actuate the neck 10 along the vertical axis 16 to another random spot. Once a session is finished, the control system 40 or actuation system 30 may actuate the telescopic neck 10 down the axis 16 to become fully encased in the housing 8, creating ease of usage, set up, storage, and portability.

Figure 5:
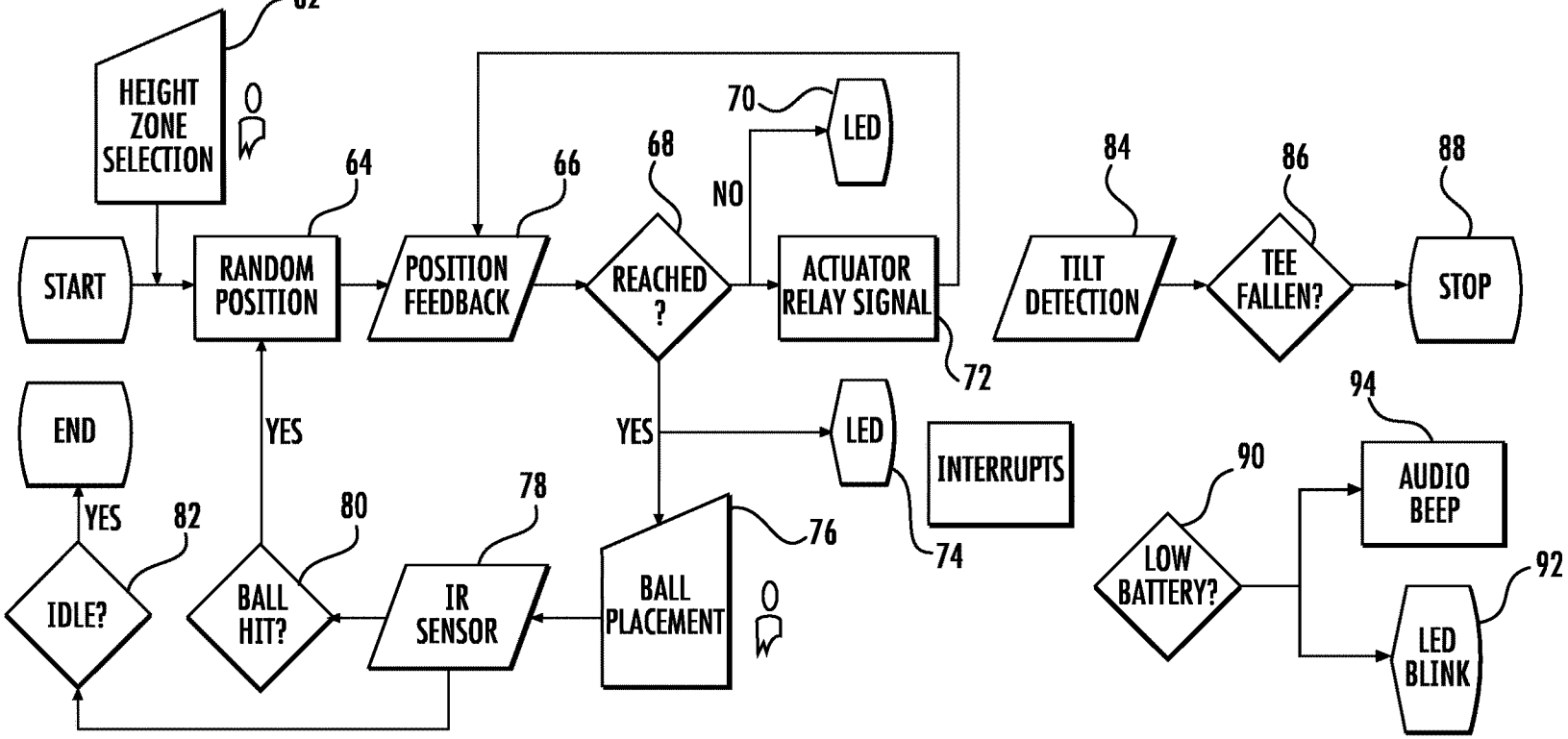
FIG. 5 is a flowchart illustrating operation of the tee system according to various embodiments described herein.

FIG. 5 is a flowchart depicting an operation of the control system 40 according to various embodiments. As shown in FIG. 5, and with further reference to FIGS. 1-4, the control system 40 initially receives a height zone selection 62 from a user, which may be entered or selected at a user interface 44 and includes a minimum and maximum height, e.g., a range between approximately 18 inches off the ground to 47 or 48 inches off the ground. The user may set the range locally at a local user interface 50 or remotely at a remote interface 56, which is generally based on the height of the user, stance, and strike zone, such as major league strike zone rules. The actuation system 30 may raise the neck 10 to a spot within the set range. A position sensor 46 may detect position data and provide position feedback 66 to the control module 48, which determines if the position has been reached 68. If the position has not been reached, an indicator display 52 emits a red light 70 and the actuator is signaled 72 to move or continue to move the neck 10. The position sensor 46 provides position feedback 66 to the control module 48, which determines if the position has been reached 68. If the position has been reached, an indicator display 52 emits a green light 74, indicating that the user may place the ball 76 on the ball seat 18 of the ball holder 12. A ball presence sensor 58, an IR sensor 78 in the flowchart, may be used to detect ball presence data and provide the ball presence data to the control module 48. If the ball presence data indicates that the ball has been hit 80, the control module 48 initiates the actuation system 30 to actuate the neck 10 to the next random position 64 within the range set at 62. If the ball presence data does not indicate that the ball has been hit 80, the control module 48 idles 82 until ball presence data indicates the ball has been hit 80. The operation loop may include interrupts, e.g., powering off, user indicating new program or session, etc. FIG. 5 includes two interrupts. At 84, the tilt detection sensor 60 detects tilt data and provides it to the control module 48. The control module 48 interprets the tilt data to determine if the body 4 has fallen 86. If the control module 48 determines if that the body has fallen, the control module 48 signals the actuation system 30 to stop 88. The control system 40 may also be configured to detect low battery power. If the control module 48 detects low batter power 90, the control module 48 may display a blinking LED 92, emit an audio beep 94 through a speaker, or both.

Referring again to FIG. 1, in various embodiments, the tee system 2 includes or incorporates a location indicator system 100. The location indicator system 100 may be provided with the tee system 2 or may be modularly associable with the tee system 2 or other tee systems, such as conventional tee systems. The location indicator system 100 may be integrated with the tee system 2, attachable to the body 4, neck 10, ball holder 12, or may be independently positioned. The location indicator system 100 may be operably connected to the body 4, e.g., through a fitting such as a USB port for coupling accessories to the tee system 2. In various embodiments, the location indicator system 100 may couple to the control system 40 of the tee system 2. For example, further to the operations described above with respect to FIG. 5, simultaneous to or close in time with each random positional movement of the neck 10, the location indicator may project a light on a batting net illuminating a goal location toward which the batter is to attempt to direct the ball. Once the ball is hit, the neck 10 will move to another random spot along the axis 16 and the light will be projected on another random spot on the net. This exercise will instruct situational hitting and further reinforce longer term learning through the randomization process.

Figure 6:
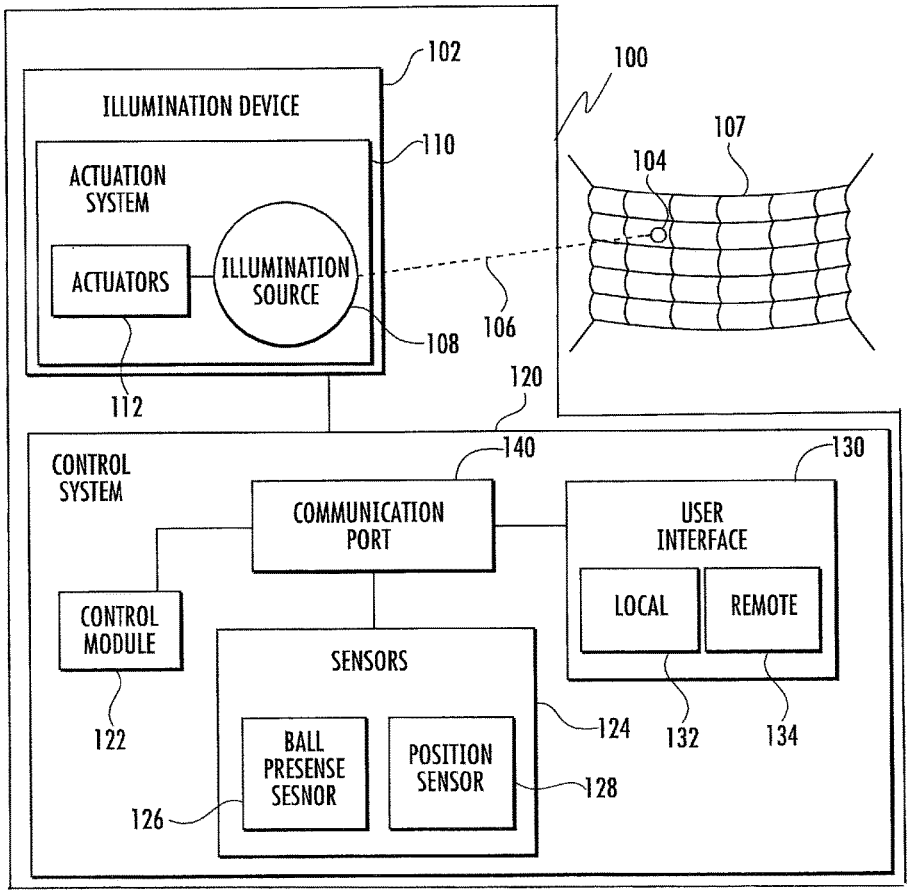
FIG. 6 schematically illustrates various operational features of a location indicator system according to various embodiments described herein.

With further reference to FIG. 6, schematically illustrating various features of a location indicator system 100, the system 100 may include an illumination device 102 for illuminating a path or goal location 104 that a batter is to direct the ball. For example, the illumination device 102 may be operable to project a beam of light 106 away from the ball holder 12. The beam of light 106 may illuminate the goal location 104 away from the tee, such as a portion of a batting net 107. That is, in one example, the illumination device 102 is configured to project a light onto the net 107 to illuminate a goal location 104 where the hitter is to direct the ball. The net 107 may be reflective such that the goal location 104 may better illuminate. The illumination device 102 may include one or more illumination sources 108 that emit light to illuminate the goal locations. Example illumination sources include light bulbs, laser diodes, LEDs, or other light emitting devices. The illumination device 102 may include light focusing structures such as lenses or mirrors to focus the light to produce a projectable beam of light 106 to identify the goal location 104. In one example, the goal location 104 indicated may be a small "pin point" to about a foot or two in average dimension at a range of about 5 to 10 feet from the ball holder 12. However, other goal location 104 sizes and locations of illumination may be used. In one example, the goal location 104 may be indicated by about a 4 to 8 inch illuminated area when projected about 5 to 10 feet from the ball holder 12.

With further reference to FIG. 6, schematically illustrating various features of the location indicator system 100, the illumination device 102 may include an actuation system 110 configured to move the illumination source 108. In some embodiments, the actuation system 110 is configured to alter the projection of light from the illumination source 108 to move the goal location 104, which may be in addition to or instead of moving the illumination source 108. The actuation system 110 may include one or more actuators 112, e.g., servomotors or stepper motors, and be operatively coupled to a control system 120 configured with a controller module 122 for multi-axis control. The actuator 112 may include gearing or other linkages to move the illumination source 108 or redirect the projection of light produced by the illumination source 108, e.g., movable lens that collect or focus the emitted light, movable reflective structures, etc.

As introduced above, the location indicator 110 may also include a control system 120 to control the operations of the illumination device 102. The control module 122 may include a processor configured to execute instructions, which may be hardwired into the processor. The control module 122 may also include memory for storing instructions executable by the processor. The control system 120 may be configured to include a closed loop servomechanism. The control system 120 may provide for actuation control of the actuation system 110 to drive the actuator 112 to move the illumination source 102 or projection of light emitted from the illumination source, e.g., by redirecting the light, data collection/sensing via sensors 124, and interfacing the user with the operations of the control system 120 via a user interface 130, which may include a local user interface 134, a remote user interface 136, or both. For example, the control system 120 may include sensors 124 or be configured to receive via wired or wireless communication ball presence data from one or more ball presence sensors 126 positioned to detect presence of the ball, such as the ball on the ball seat 18 or the hitting of the ball. In one embodiment, the sensors 124 may also include a position sensor 128 to provide position data to the control module 122 for performing control operations with respect to the actuator 112. In one example, a position sensor 128 includes a potentiometer to monitor rotation of a disc drive of the motor/actuator which corresponds to the illumination source 108 position. In this or another embodiment, the actuation system 110 incorporates a stepper motor or servomotor configured with position control incorporating an encoder or potentiometer in a closed loop. The control module 122 may also include a PID controller, for example.

The user interface 130 may provide the user access to control system 120 to select or specify various operations of the location indicator system 100. For example, the user interface 130 may allow a user to set timing of goal location 104 changes, which may use or integrate sensors 124, a range of goal locations 104, e.g., using a range selection switch, or both. The control system 120 is typically embedded with a random goal location generator, which may be programmed into a microcontroller board, to generate random goal locations 104. In one embodiment, the user interface 130 may allow a user to select a non-random goal location sequence such as one that relates locations with the height of the ball holder 12. In any of the above or another embodiment, the user interface 130 may allow a user to select a hold instruction to hold the height position, goal location 104, or both for one or more additional hits or period of time.

Figure 7:
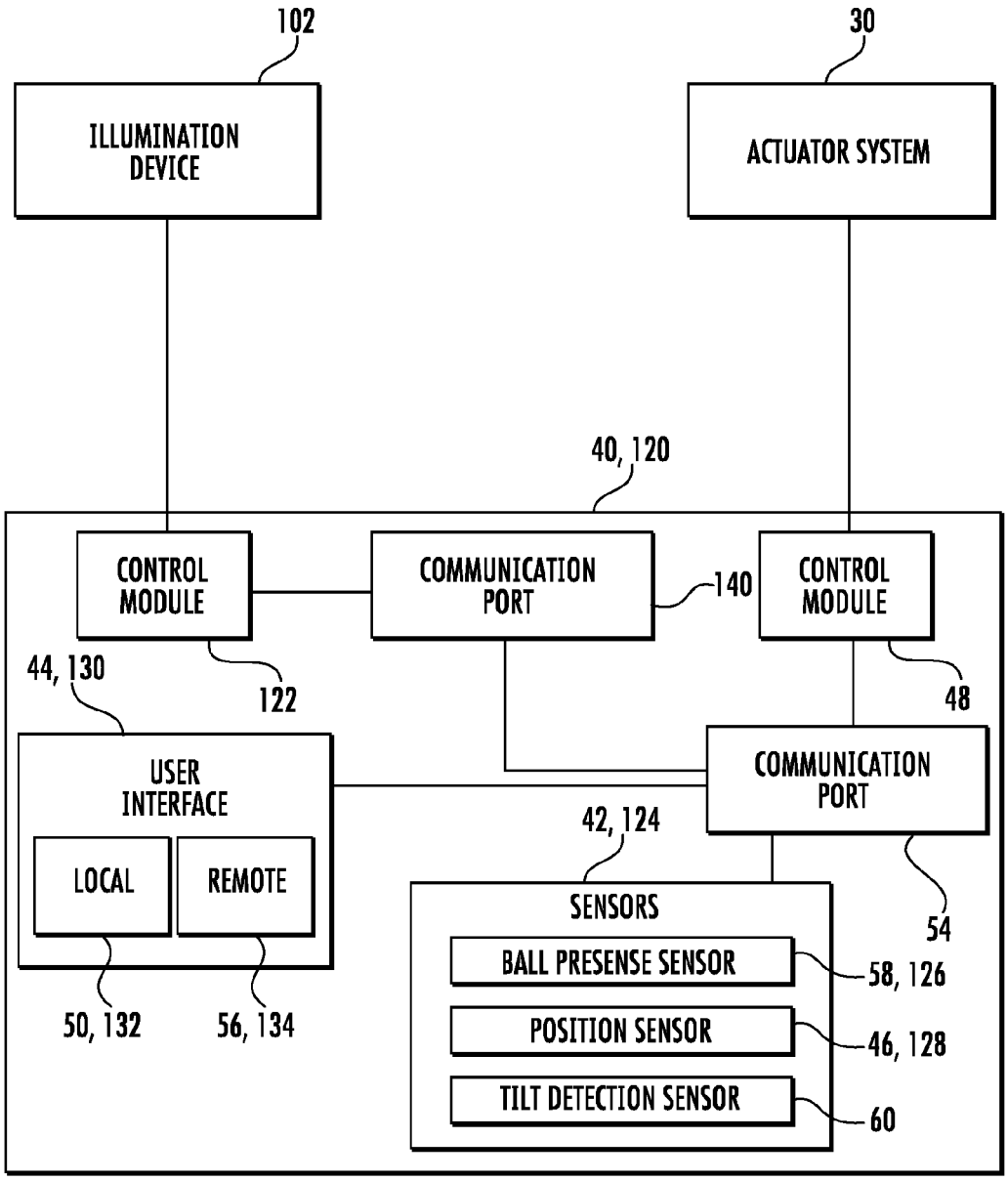
FIG. 7 schematically illustrates various operational features of a location indicator system operationally coupled with a tee system according to various embodiments described herein.

The control system 120 may also include a communication port 140, which may include multiple communication ports 140. With further reference to FIG. 7, the communication port 140 may be configured to effectuate communication between the control system 120 and other devices, such as the tee system 2, sensors 42, 124, or external or remote devices 55 wired or wirelessly coupled to the communication port 140, which may include a remote interface 134. For example, the communication port 140 may comprise a transmitter, receiver, or transceiver configured for wired communication, wireless communication, e.g., Bluetooth, IR, Wi-Fi, radio, etc., or both. The communication port 140 may transmit operational data, e.g., to an external or remote device 55 such as a computer, laptop computer, tablet, smart phone/device, or dedicated remote interface 134. In some embodiments, when communication ports 54, 140 are in wired or wireless signal communication, local user interface 46 may interface the user with the operations of both the tee system 2 and the location indicator system 100. In one example, the communication port 140 may include Bluetooth communication hardware to wirelessly pair the control system 120 with an external or remote device 55, such as a smart phone, operable as a remote user interface 134, or sensors 124, such as a hearing device, tactile-vibration feedback device, or both ; thus, the user, using a remote user interface 134 embodied in a mobile application run on an external or remote device 55, may remotely interface with the control system 120 to, for example, set a range of locations for randomized presentation from the illumination device 102. Similarly, when the illumination device 102 includes a local interface 132, the local user interface 132 may be used to set a range of locations for randomized presentation from the illumination device 102. In some embodiments, a user may also set a category of ranges or select a program of locations for randomized presentation from the illumination device 102.

In various embodiments, the illumination device 102 may be integrated with the body 4 of the tee system 2. For example, the illumination device 102 may be housed in the housing 8 to project a beam away from the ball holder 12. In a further example, the illumination source 108 may be positioned within the housing 8 to project the beam through a transparent cover. The illumination device 102 may also be mountable to the body 4 or another batting tee, such as a conventional batting tee. In one example, the illumination device 102 includes a clamp for clamping the illumination device 102 to the body 4, such as at the base 6, housing 8, neck 10, or ball holder 12. Other methods of mounting the illumination device 102 may include adhesives, bolts, screws, compression fittings, brackets, rail and groove, or other suitable mountings. In another embodiment, the illumination device 102 may be mounted separately or independently from the body 4, e.g., using a stand, tripod, stake, or positioning on a surface.

In one embodiment, the body 4 includes an accessory fitting 150 on the base 6, housing 8, neck 10, or ball holder 12 for coupling the illumination device 102. In one embodiment, the accessory fitting 150 includes a USB port. The accessory fitting 150 or another fitting may include a power fitting for providing power to the location indicator system 100. For example, the illumination device 102 may obtain power from a power source via the power fitting. The power source may include an onboard battery associated with the body 4 or an a/c outlet. In one embodiment, the body 4 houses a designated accessory battery for powering accessories coupled to the tee system 2. The body 4 may include a socket or plug configured to couple to an a/c outlet to recharge the accessory battery. In one embodiment, the illumination device 102 may be separately powered, e.g., with a battery.

The accessory fitting 150 or another fitting may include a data link fitting. The data link fitting may comprise a wired communication port, such as communication port 54. For example, the location indicator system 100 or another accessory may communicatively couple to the tee system 2 through a data link fitting. In some embodiments, the location indicator system 100 may couple to the control system 40 of the tee system 2 via the data link fitting. Coupling at the data link fitting may couple the communication port 140 of the location indicator system 100 with the communication port 54 of the tee system 2. The control systems 40, 120 of the tee system 2 and location indicator system 100 may communicate, e.g., to obtain sensor data, integrate control operations, or provide a combined user interface 44, 130, either local or remote. Thus, a user may interface with both the operation of the neck 10 and the location indicator system 100 at a local interface, e.g., a local interface 50, 132, a remote interface, e.g., remote interface 56, 134, or both. In one embodiment, the control module 48 of the tee system 2 is operable as the control module 122 of the location indicator system 120 when coupled thereto.

In one embodiment, the control systems 120, 40 of the illumination device 102 and tee system 2 wirelessly couple, e.g., pair or communicate via wireless data transmissions and signaling, which may be in addition to or instead of wired coupling. In these or another embodiment, the location indicator system 100 includes a user interface 130, e.g., on the illumination device or remotely. An interface 130 that includes a remote interface may be provided through an application run on a computer, laptop, tablet, smart phone, or dedicated remote device paired with or otherwise in wireless signal communication with the operations of the illumination device 102 through the communication port 140.

As introduced above, the control system 120 may include one or more sensors 124. The sensors 124 may include ball presence sensors 126 to detect the presence, or absence, of the ball on the ball seat 18. Additionally or alternatively, ball presence sensors 126 may include sensors to detect that the ball has been hit. For example, the presence sensors 126 may include sensors to detect vibration or movement of the ball holder 12, movement of a ball from the ball holder 12, weight of or applied to the ball holder 12, light or optical sensors, sound sensors, or other suitable sensors. In one embodiment, a ball presence sensor 126, such as a vibration sensor, may detect vibrations of the ball holder 12 to estimate speed of the ball. In one embodiment, the control system 120 is in communication with the position sensor 46 of the tee system 2 to obtain position data related to the height the neck 10 extends from the body 4. In various embodiments, the location indicator system 100 may couple, either wired or wirelessly, to the control system 40 of the tee system 2 such that the control system 40 is operable to control the operations of the location indicator system 100.

In various embodiments, the user interface 130 includes a next switch for advancing to the next goal location 104. The next switch may be provided on a local interface 132, remote interface 134, or both. The next switch may be instead of or in addition to a ball presence sensor 126 used by the control module 122 to determine if the ball has been hit. The next switch may include a button or foot switch, for example.

It will be appreciated that the embodiments described herein may include additional or fewer features and components. Similarly, the present disclosure is not intended to be limited by the specific embodiments described as those having skill in the art upon reading this disclosure will understand that the teachings herein may be applied to in various ways to batting tee systems. For example, in one embodiment, the location indicator system 100 includes an illumination device 102 comprising a net having specifically illuminable locations. The net may incorporate LEDs that may be selectively energized to emit light thereby illuminating random sequential goal locations 104 on the net as described above.

In any of the above embodiments or another embodiment, the tee system 2 may be configured to provide feedback to the batter. The feedback may be provided by the location indicator system 100, which may include a feedback system. The feedback system may be provided in addition to or instead of the goal location device 102. The feedback system may be a separate feedback system, which may be independently controlled by a separate control system or operatively coupled to or under the control of one or both of control system 40 and control system 120. In embodiments including a location indicator system 100 including an illumination device 102 that projects light onto a net 104 (see, e.g., FIG. 6), the location hit may be illuminated by a second beam of light projected onto the net 104 by the illumination device 102 using the same or different illumination source 108, directed by the control system 120 in communication with a sensor 124 to sense the location the ball was directed or struck the net 104. In one embodiment, sensors may be associated with a net to detect the location the ball strikes the net, e.g., optical, vibration, thermal, or other suitable sensors. Location data may be transmitted to control module 122, control module 48, another control module, or combination thereof, which may be used to determine the location the ball hit the net. In one embodiment, the illumination source 108 or another illumination source is directed to illuminate the location hit. In one embodiment, a net is configured to provide feedback to the batter by illuminating the location where the ball struck the net. For example, the net may be in signal communication with one or both of control system 40 or control system 120. In one embodiment, the net may be configured to operate independently of one or both of control system 40 and control system 120. According to any of the above embodiments, after the ball strikes the net, the location where the ball hit the net may be illuminated, e.g., light projected onto or emitted by the net. In various embodiments, the location may be illuminated in a same color as the goal location, different color as the goal location, during illumination of the goal location, after illumination of the goal location, or any combination thereof In one example, at least one of the goal location or the location hit may flash. The duration of time that the location hit is illuminated may be set such that after a predetermined period of time illumination of the location hit is discontinued and a next random goal location is illuminated. As another example, the location hit may remain illuminated until the tee translates to the next random position. In either example, control of illumination of the location hit may be separate or under the control of control system 40 or control system 120. In one example, the feedback system is in one or two-way communication with control system 40 or control system 120 such that sensor data or control operation instructions may be transmitted and used to sequence operations of the actuation of the neck, illumination of the goal location, and illumination of the location hit. In some embodiments, the location hit may be excluded from the set of acceptable next random goal locations. In other embodiments, the location hit is not considered in the generation of the next random goal location. It is to be understood that the feedback system may be separately usable without one or both of the tee actuator system 30 and the location indicator system 100.

Any references to "various embodiments," "certain embodiments," "some embodiments," "one example," "one embodiment," "an example," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not necessarily refer to the same embodiment. Furthermore, the phrases "in one such embodiment" or "in certain such embodiments," or "in one example," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims. 100631 The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise. Additionally, the grammatical conjunctions "and" and "or" are used herein according to their accepted usage. By way of example, "x and y" refers to "x" and "y". On the other hand, "x or y" refers to "x", "y", or both "x" and "y", whereas "either x or y" refers to exclusivity.

What is claimed is:

1. A batting tee system, the batting tee system comprising:

a housing;

an actuation system comprising a neck movable along a vertical axis, an actuator comprising one or more motors and linkages positioned within the housing, a ball holder for holding a ball, wherein the ball holder is mounted on the neck and wherein a length of the neck can be increased or decreased between the ball holder and the housing; and a control system operable to control operation of the batting tee system, comprising a plurality of sensors, a user interface for interfacing a user with operation of the control system for actuation of movement of the neck along the vertical axis; and a control module, the control module operable to cause the actuator to actuate the neck to a first random position along the vertical axis, wherein the control module is further operable to cause the actuator to actuate the neck from the first random position to a second random position along the vertical axis, different than the first random position, after a ball is hit from the ball holder when the neck is in the first random position.

2. The batting tee system of claim 1, wherein one of the plurality of sensors includes a ball presence sensor positioned to collect ball presence data, and wherein the control module is configured to analyze the ball presence data collected by the ball presence sensor to determine when a ball has been hit from the ball holder.

3. The batting tee system of claim 2, wherein the ball presence sensor comprises an IR proximity line-of-sight sensor used to detect the presence of a ball on the ball holder.

4. The batting tee system of claim 1, wherein the neck is completely retractable into the housing.

5. The batting tee system of claim 1, wherein a length of the neck increases when the distance between the ball holder and the housing increases, and wherein the length of the neck decreases when the distance between the ball holder and the housing decreases.

6. The batting tee system of claim 5, wherein neck comprises nestable telescoping sections that move along the vertical axis when the neck is actuated along the vertical axis.

7. The batting tee system of claim 1, wherein the control system further comprises a remote user interface to interface a user with operations of the control module, and wherein the remote user interface is operable to allow the user, via a remote device, to define a range within which the first and second random positions along the axis are to be generated.

8. The batting tee system of claim 1, further comprises, a location indicator system coupled to the control system and including an illumination device having an illumination source, wherein the illumination device is operable to project a beam of light away from the ball holder of the batting tee system with light emitted from the illumination source, wherein the illumination device is configured to project a light onto a goal to illuminate a goal location where a user is to direct a ball; and wherein the location indicator system includes a control system operable to cause the actuator to direct a light emitted from the illumination source to a first random goal location and redirect the emitted light to a second random goal location, different from the first random goal location, after a ball is hit from the ball holder when the first random goal location is illuminated.

9. The batting tee system of claim 8, wherein the control system further comprises a remote user interface to interface a user with operations of the illumination control module, and wherein the remote user interface is operable to allow a user, via a remote device, to define a range within which the first and second random positions along the axis are to be generated.

10. The batting tee system of claim 9, wherein the remote user interface is further configured to interface a user with operations of the control module, and, wherein the remote user interface is operable to allow the user, via a remote device, to define a minimum and maximum range within which the first and second random positions along the vertical axis are to be generated.

11. The batting tee system of claim 8, wherein one of the plurality of sensors includes the a ball presence sensor positioned to collect ball presence data, wherein the illumination control module is in signal communication with the ball presence sensor to receive ball presence data, and wherein the illumination control module is configured to analyze the ball presence data to determine when a ball has been hit from the ball holder.

12. The batting tee system of claim 9, wherein the control system further comprises a ball presence sensor positioned to collect ball presence data, wherein the control module is configured to analyze the ball presence data collected by the ball presence sensor to determine when a ball has been hit from the ball holder, and wherein the illumination control module is in signal communication with the control module control system configured to cause actuation of the neck to receive a signal that the ball has been hit from the ball holder.

13. The batting tee system of claim 8, wherein the illumination actuator is configured to direct the light emitted from the illumination source by one of moving the illumination source, redirecting the light emitted from the illumination source, or both.

14. The batting tee system of claim 8, wherein when the illumination actuator is in signal communication, via a communication port, with the control module the control module is operable to cause the illumination actuator to one of direct the illumination source, direct the light emitted from the illumination source, or both.

* * * * *